US011706570B2

(12) United States Patent
Mohammadi et al.

(10) Patent No.: US 11,706,570 B2
(45) Date of Patent: Jul. 18, 2023

(54) DUAL-DIAPHRAGM MOVING-COIL AUDIO TRANSDUCER FOR HEARING DEVICE

(71) Applicant: Knowles Electronics, LLC, Itasca, IL (US)

(72) Inventors: Mohammad Mohammadi, Rolling Meadows, IL (US); Christopher Lane Monti, Elgin, IL (US)

(73) Assignee: Knowles Electronics, LLC, Itasca, IL (US)

( * ) Notice: Subject to any disclaimer, the term of this patent is extended or adjusted under 35 U.S.C. 154(b) by 21 days.

(21) Appl. No.: 17/404,902

(22) Filed: Aug. 17, 2021

(65) Prior Publication Data

US 2023/0057158 A1 Feb. 23, 2023

(51) Int. Cl.

| | |
|---|---|
| ***H04R 9/02*** | (2006.01) |
| ***H04R 7/16*** | (2006.01) |
| ***H04R 1/10*** | (2006.01) |

(52) U.S. Cl.

CPC ..... *H04R 9/025* (2013.01); *H04R 1/1091* (2013.01); *H04R 7/16* (2013.01); *H04R 2460/11* (2013.01)

(58) Field of Classification Search

CPC .... H04R 7/16; H04R 1/1091; H04R 2460/11; H04R 9/025

See application file for complete search history.

(56) References Cited

U.S. PATENT DOCUMENTS

| | | | | |
|---|---|---|---|---|
| 10,631,096 | B1 * | 4/2020 | Garcia Selva ..... | H04R 9/06 |
| 2018/0213318 | A1 | 7/2018 | Wiederholtz et al. | |
| 2020/0267476 | A1 | 8/2020 | Huang | |
| 2021/0120342 | A1 | 4/2021 | Huang | |
| 2021/0204065 | A1 | 7/2021 | Albahri et al. | |
| 2021/0204066 | A1 | 7/2021 | Nadella et al. | |

FOREIGN PATENT DOCUMENTS

KR 1501898 B1 * 3/2015

OTHER PUBLICATIONS

Samsung Electronics Co. Ltd., FCC report, FCC ID.: A3L SMR190L, "Bluetooth Headset", https://fcc.report/FCC-ID/A3LSMR190L/, portions dated Nov. 30, 2020 and portions dated May 29, 2021 (see index pp. 1-4 of part 1), uploaded document broken up into 2 parts.

* cited by examiner

*Primary Examiner* — Sunita Joshi
(74) *Attorney, Agent, or Firm* — Loppnow & Chapa

(57) ABSTRACT

The present disclosure relates to dual-diaphragm moving-coil audio transducers for hearing devices. The transducer includes a magnetic circuit including an inner portion located between first and second coils coupled to corresponding diaphragms supported by a housing. An outer portion of the magnetic circuit is adjacent outer portions of the first and second coils. The transducer emits sound when the first diaphragm moves in a first direction and the second diaphragm moves in a second direction, opposite the first direction, in response to an electrical audio signal applied to the first and second coils.

20 Claims, 8 Drawing Sheets

DUAL-DIAPHRAGM MOVING-COIL AUDIO TRANSDUCER FOR HEARING DEVICE

FIELD OF THE DISCLOSURE

The present disclosure relates generally to audio transducers suitable for hearing devices and more particularly to dual-diaphragm moving-coil audio transducers for hearing devices worn in or on a user's ear, and combinations thereof.

BACKGROUND

The market for hearing devices worn in or on the user's ear is expected to continue to grow. Such hearing devices include traditional prescription and emerging over-the-counter hearing aids as well as wired and wireless headphones and earpieces that can be paired with laptop computers, mobile phones and other devices for hands-free communications and audio content listening. Essential components of these and other hearing devices are relatively small-size and low-cost audio transducers with high performance and reliability.

BRIEF DESCRIPTION OF THE DRAWINGS

The objects, features and advantages of the present disclosure will become more fully apparent from the following detailed description and the appended claims considered in conjunction with the accompanying drawings. The drawings depict only representative embodiments and are therefore not considered to limit the scope of the disclosure.

Figure 1:
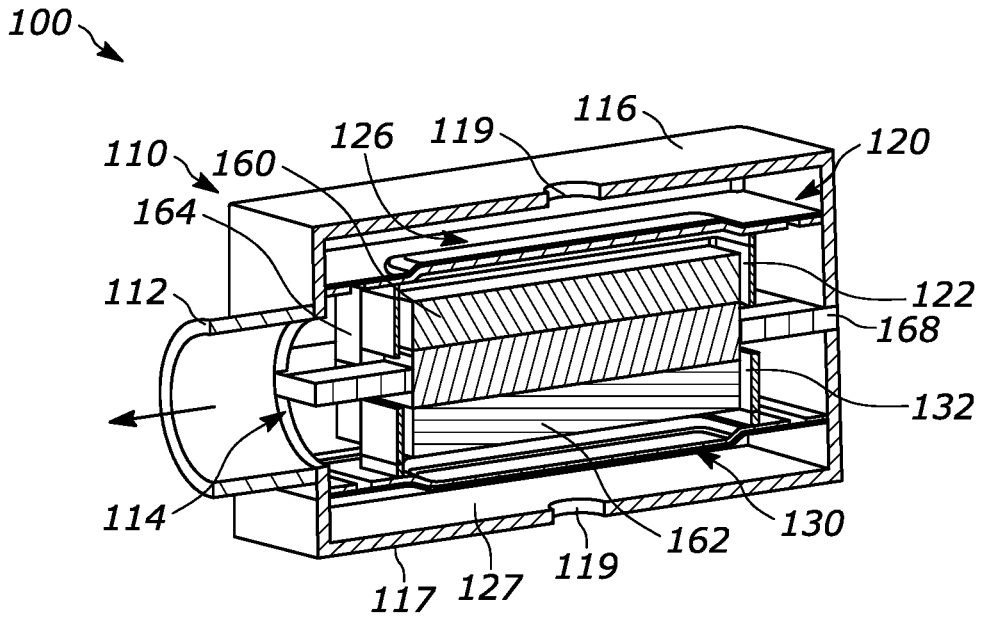
FIG. 1 is a sectional view of a representative audio transducer having a front volume located between first and second diaphragms.

Those of ordinary skill in the art will appreciate that the drawings are illustrated for simplicity and clarity and therefore may not be drawn to scale and may not include well-known features, that the order of occurrence of actions or steps may be different than the order described or may be performed concurrently unless specified otherwise, and that the terms and expressions used herein have the meaning understood by those of ordinary skill in the art except where different meanings are attributed to them herein.

DETAILED DESCRIPTION

The present disclosure relates generally to audio transducers for hearing devices and more particularly to dual-diaphragm moving-coil audio transducers suitable for hearing devices worn in or on a user's ear. Such hearing devices include but are not limited to traditional prescription and over-the-counter hearing aids, wired earphones, and wireless headphones and ear pieces, e.g., true wireless stereo (TWS) earpieces, that can be paired with laptop computers, mobile phones and other devices for hands-free communications and audio content listening. More generally, the transducers described herein can be scaled in size for use in applications other than hearing devices. Such other applications can include portable wireless speakers connectable to a sound source via Bluetooth or other wireless technology.

The audio transducer generally comprises a magnetic circuit including an inner portion disposed between first and second coils coupled to corresponding diaphragms supported by a housing. The housing may or may not have a sound port. The magnetic circuit also includes an outer portion adjacent to outer portions of the first and second coils. In operation the first diaphragm moves in a first direction and the second diaphragm moves in a second direction, opposite the first direction, in response to an electrical excitation, e.g., an audio, signal applied to the first and second coils, whereby the audio transducer produces sound in response to the excitation signal. Generally the current in the first and second coils must be in the same direction to drive the diaphragms in opposite directions in response to the same excitation signal.

In FIGS. 1, 3, 6, 8, 12 and 14, a dual-diaphragm audio transducer 100 comprises a housing 110 having a sound port, a first diaphragm 120 coupled to a first coil 122, a second diaphragm 130 coupled to a second coil 132, and a magnetic circuit disposed between the first and second diaphragms as described further herein. In the embodiments shown, a nozzle 112 is acoustically coupled to the sound port. In other implementations however the nozzle may not be required, depending on the use case and requirements of the host device.

Generally an inner portion of the first coil is at least partially aligned with an inner portion of the second coil and the first and second diaphragms are parallel or nearly so. In the embodiments shown, the first diaphragm is parallel to the second diaphragm and axial dimensions of the first and second coils are aligned. The axial dimension of the coil is a dimension about which windings of the coil are arranged shown at 102 in FIGS. 3 and 14. As used herein axial dimension applies to cylindrical coils as well as coils having square, rectangular and other shapes. In other implementations, the first and second diaphragms can be somewhat non-parallel and the axial dimensions of the coils can be somewhat offset, provided that the inner portion of the magnetic circuit can be accommodated partially within inner portions of the first and second coils.

Figure 12:
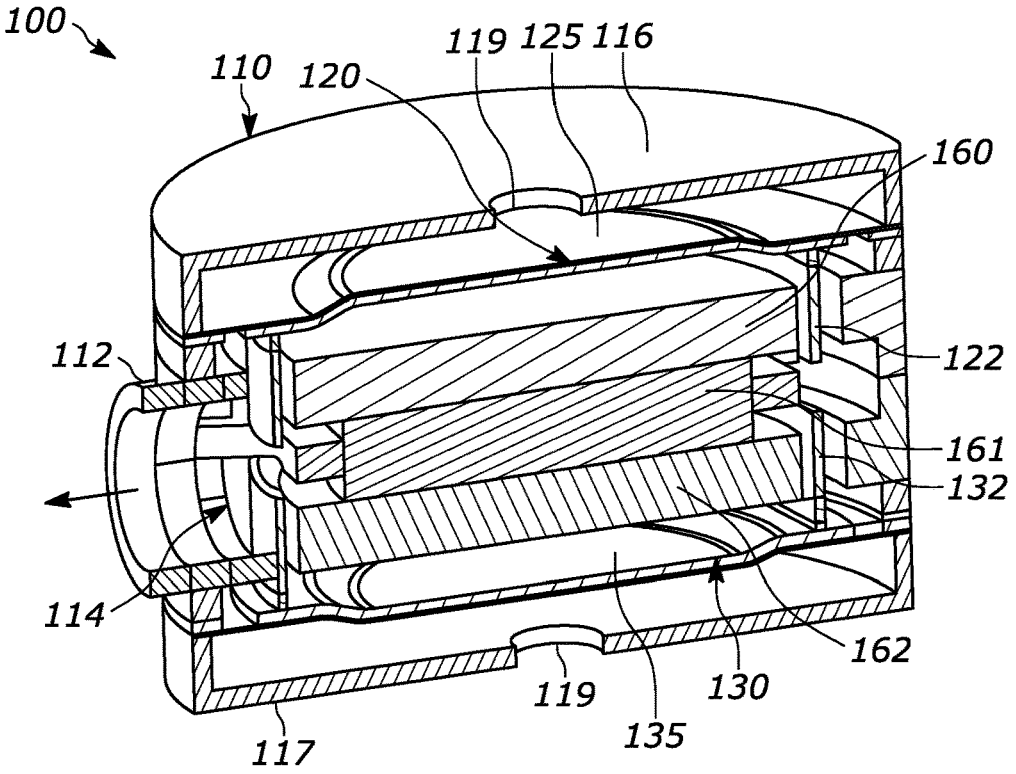
FIG. 12 is a sectional view of a cylindrical transducer having a front volume between first and second diaphragms.

In FIGS. 1, 3, 6 and 8, the housings 110 are generally shaped like rectangular cuboids and the diaphragms 120 and 130 have a generally rectangular shape. In other implementations, the housings can be cubic and the diaphragms are generally shaped like square. In FIG. 12, the housing 110 is generally cylindrical and the diaphragms 120 and 130 have a disk shape. The housing and associated diaphragms can also have other shapes, including irregular shapes. More generally, the shape of housing can differ from the shape of one or more of the diaphragms associated with the housing.

Figure 13:
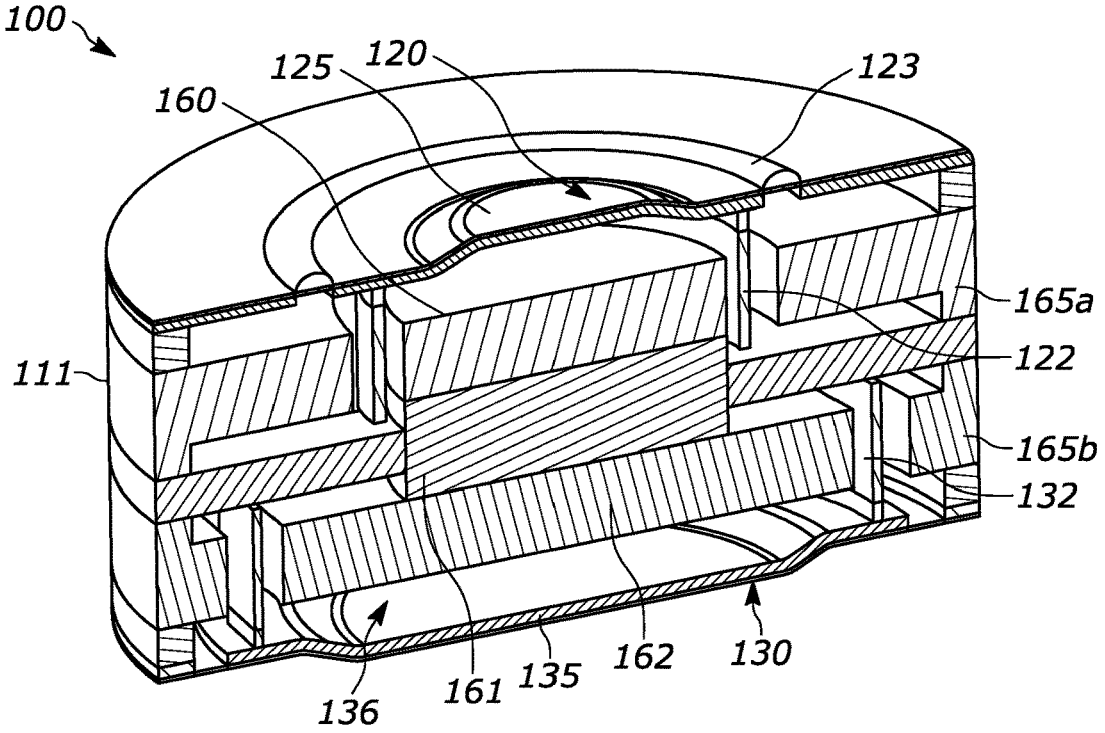
FIG. 13 is a sectional view of another cylindrical transducer having a back volume between first and second diaphragms.

In FIGS. 1, 3, 6, 8, 12 and 14, the first diaphragm 120 is the same size as the second diaphragm 130. In FIG. 13, the first diaphragm 120 is smaller in diameter than the second diaphragm 130. The other housing shapes contemplated by the present disclosure can also have different sized and shaped diaphragms for this purpose. In FIGS. 1, 3, 6, 8 and 12 for example the first and second rectangular diaphragms can have different sizes. The transducer can be configured to produce sound within different parts of the audio spectrum by using diaphragms having different dimensions and/or different resonant characteristics attributable to shape, material properties like stiffness and mass, among others.

Figure 9:
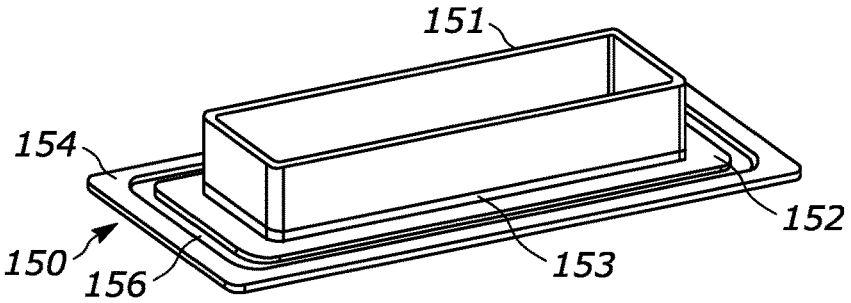
FIG. 9 is a perspective view of a diaphragm and coil.
Figure 10:
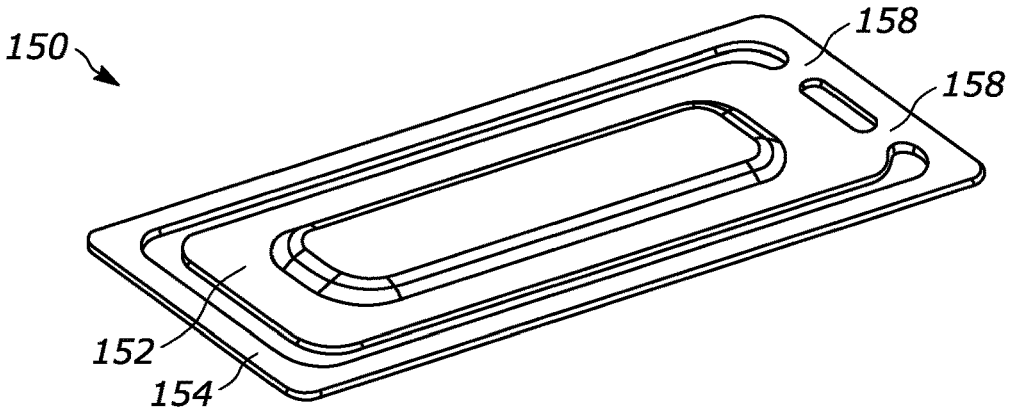
FIG. 10 is a perspective view of a hinged diaphragm component.
Figure 11:
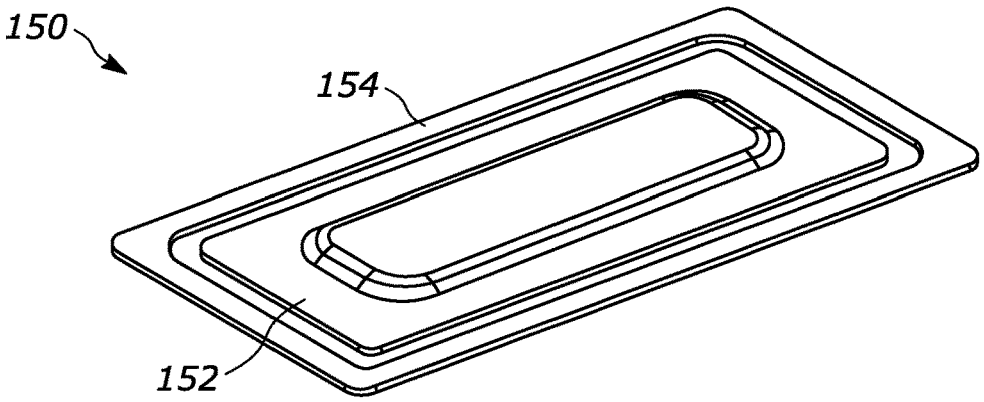
FIG. 11 is a perspective view of an unhinged diaphragm component.

In FIG. 9, the diaphragm 150 comprises a paddle 152 movably coupled to a frame 154 by a flexible member 156, which functions like a suspension. A coil 151 is fastened to the paddle by an epoxy 153 or other fastening technique. Alternatively, the coil can be wound about a bobbin formed as an integral part of the paddle. FIGS. 10 and 11 show the paddle and frame without a flexible member. In FIG. 10, the paddle 152 is coupled to the frame 154 by one or more cantilever hinges 158, wherein the paddle rotates or pivots about the hinges in response to an electrical excitation signal applied to the coil. Alternatively, the hinges can be of the torsional type. In FIG. 11, the paddle 152 is coupled to the frame 154 by the flexible film in the absence of a hinge, wherein the paddle exhibits substantially uniform velocity across a surface of the paddle in response to the electrical excitation signal applied to the corresponding coil. The paddle, frame and hinges, if any, can be fabricated from a metal or other material as a unitary member or as an assembly of discrete parts. The flexible material can be fabricated from a urethane, Mylar, silicone or other material suitable for this purpose as is known generally in the art.

Figure 14:
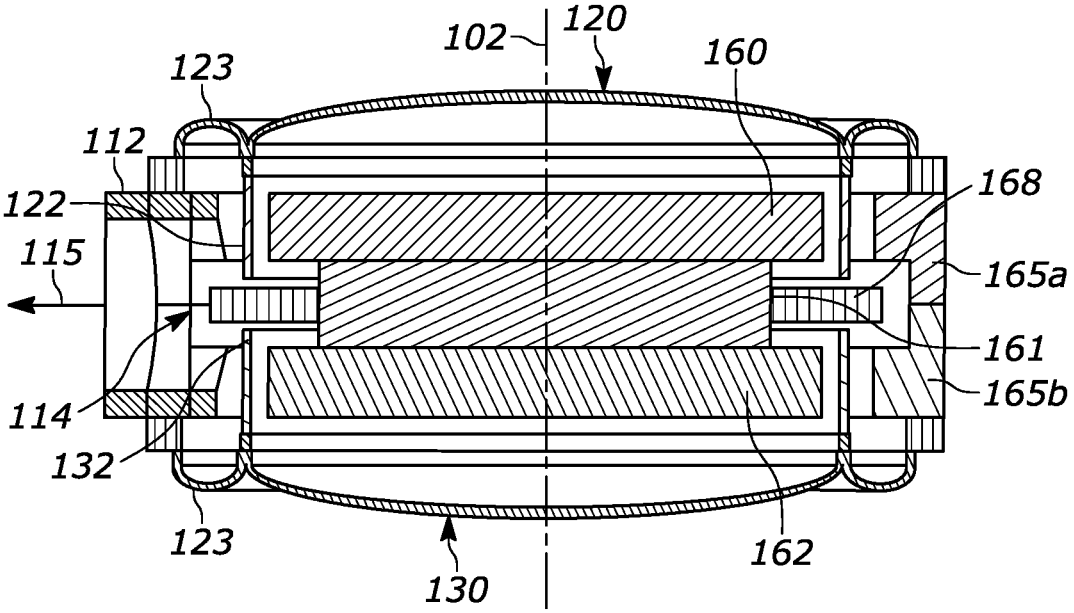
FIG. 14 is a sectional view of another cylindrical transducer.

In FIGS. 12, 13 and 14, the disk shaped diaphragms 120 and 130 can be fabricated from reinforced paper, carbon fiber or polymers including polyethylene terephthalate (PET), polyether ether ketone (PEEK), and polyetherimide (PEI), among other materials. Generally, the thickness or numbers of diaphragm material layers can be selected to produce the desired properties and performance characteristics. Also, combinations of different polymers and adhesives among other materials may be used to produce the desired properties and performance characteristics. In FIGS. 12 and 13, the diaphragms have a raised structure 125 and 135 for increased stiffness. In FIG. 14, the diaphragms 120 and 130 is formed as a unitary member having a contoured sectional shape without the raised structure shown in FIGS. 12 and 13. In other suitable implementations, the diaphragms can have a flat, quasi-conical or other shapes. The diaphragm is typically coupled to a supporting structure by a flexible suspension 123, which functions similarly to the flexible member shown in FIG. 9. The diaphragms described herein and shown in the drawings are merely representative of a variety of diaphragms suitable for the transducers described herein.

Figure 4:
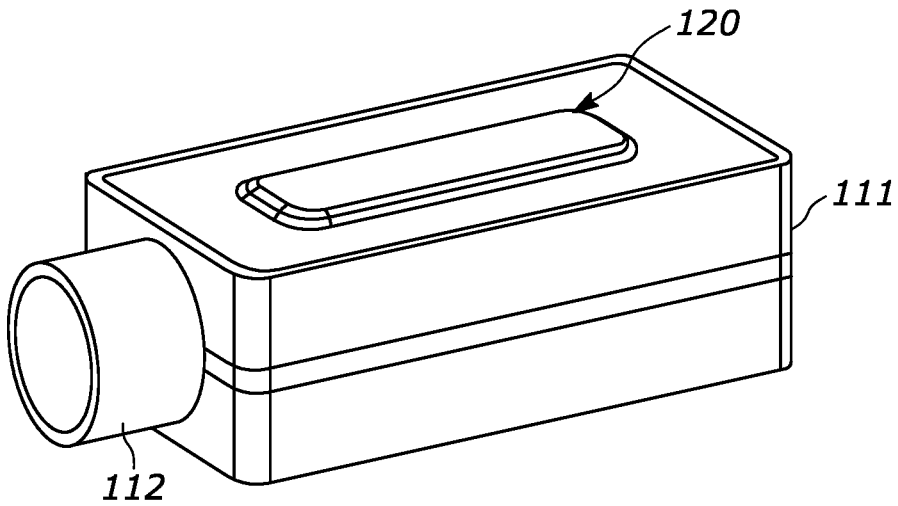
FIG. 4 is a perspective view of a representative of a transducer having an open-ended side wall housing.

In FIGS. 1, 6, 8, 12 and 14, a volume referred to as a front volume 114 is enclosed between the first and second diaphragms and a sidewall portion of the housing 110. The front volume is acoustically coupled to the sound port. In operation, the counter movement of the first and second diaphragms emits sound from the sound port via the front volume as shown by arrow 115 in FIGS. 1, 6, 8, 12 and 14. In FIGS. 1, 6, 8 and 12, the transducer comprises a first back volume 126 between the first diaphragm 120 and a first wall 116 of the housing, and second back volume 127 between the second diaphragm 130 and a second wall 117, opposite the first wall, of the housing. In some embodiments, optionally, a vent 119 acoustically couples the back volume to the atmosphere or other environment external to the housing. The vent 119 can also include a material to dampen the flow of air in and out of the volume. In FIG. 4, the housing is formed partially by an open-ended sidewall 111 and the open ends of the sidewall are covered by the first and second diaphragms. The transducer of FIG. 4 can be configured so that the front volume is located between the first and second diaphragms wherein sound is output via sound port 112 as described in connection with FIGS. 1, 6, 8 and 12. According to this representative interpretation of FIG. 4, the back volumes are open to atmosphere.

Figure 3:
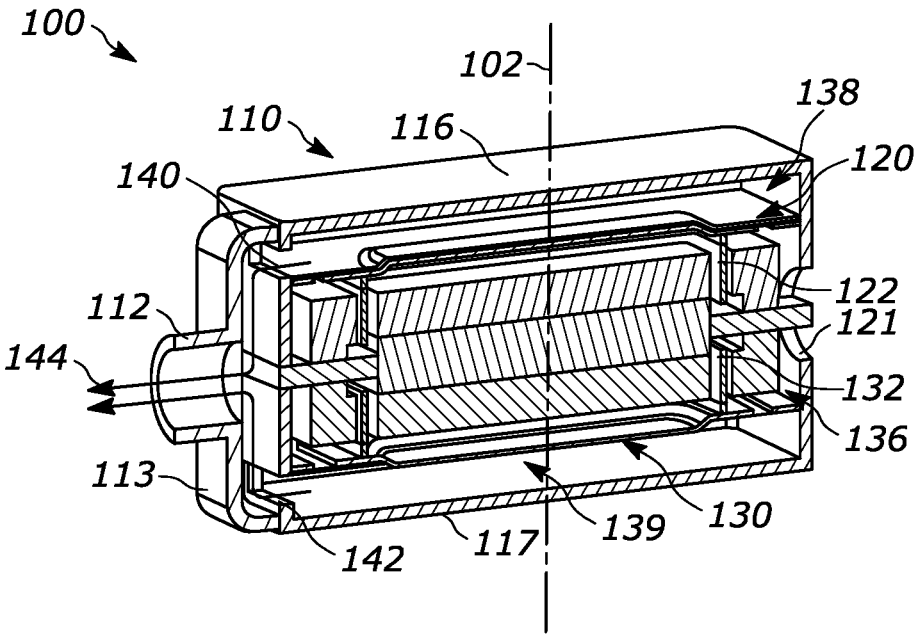
FIG. 3 is another sectional view of a representative audio transducer having a back volume between first and second diaphragms.

In FIGS. 3 and 13, a volume referred to as a back volume 136 is enclosed between the first and second diaphragms and a sidewall portion of the housing. Optionally, the back volume can be acoustically coupled to the atmosphere or other environment by a vent in the housing, shown at 121 in FIG. 3. A damping material can be disposed in or over the vent. In FIG. 3, the transducer comprises a first front volume 138 between the first diaphragm 120 and the first wall 116 of the housing, and second front volume 139 between the second diaphragm 130 and a second wall 117, opposite the first wall, of the housing. The first and second front volumes 138 and 139 are each acoustically coupled to corresponding sound ports 140 and 142, respectively. The nozzle 112 includes a cup 113 referred to as a doghouse that fits over both sound ports 140 and 142. In operation, the counter movement of the first and second diaphragms emits sound, shown by arrow 144, from the nozzle via the corresponding front volumes and sound ports. Sound from the front volumes is combined in the doghouse 113 before emanating from the nozzle 112. The transducer of FIG. 4 can be alternatively configured so that the back volume is located between the first and second diaphragms, as described in connection with FIG. 3, wherein sound is output directly to the atmosphere rather than being output via the sound port 112. According to this alternative interpretation of FIG. 4, the sound port 112 shown in FIG. 4 can be a vent for the back volume or the sound port can be eliminated to fully enclose the back volume. In FIG. 13, the first and second diaphragms 120 and 130 are exposed to the atmosphere.

Figure 2:
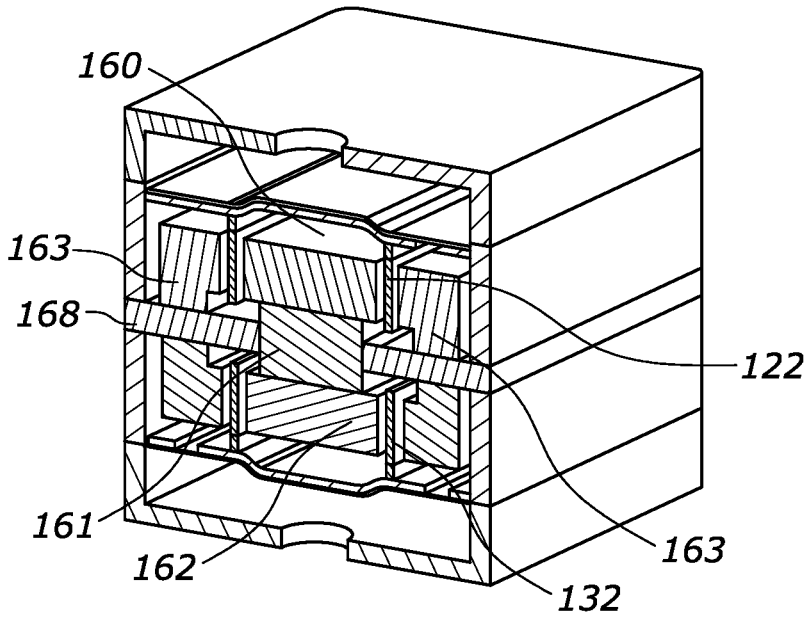
FIG. 2 is another sectional view of a representative audio transducer.

The magnetic circuit generally comprises a permanent magnet, an inner portion disposed between and extending partially within perimeters of the first coil and the second coil, and an outer portion adjacent outer portions of the first coil and the second coil. In FIG. 2, the magnetic circuit comprises a first inner pole portion 160 at least partially disposed within the inner portion of the first coil 122, and a second inner pole portion 162 at least partially disposed within the inner portion of the second coil 132, wherein the permanent magnet 161 is located between the first and second inner pole portions. The outer portion of the magnetic circuit comprises an outer pole portion 163 adjacent outer portions of the first and second coils.

Figure 5:
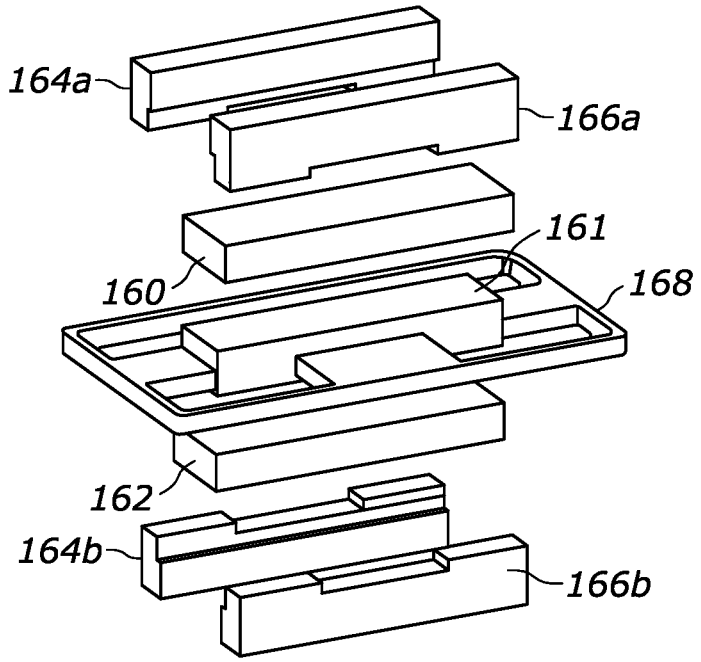
FIG. 5 is an exploded view of a representative magnetic circuit.
Figure 6:
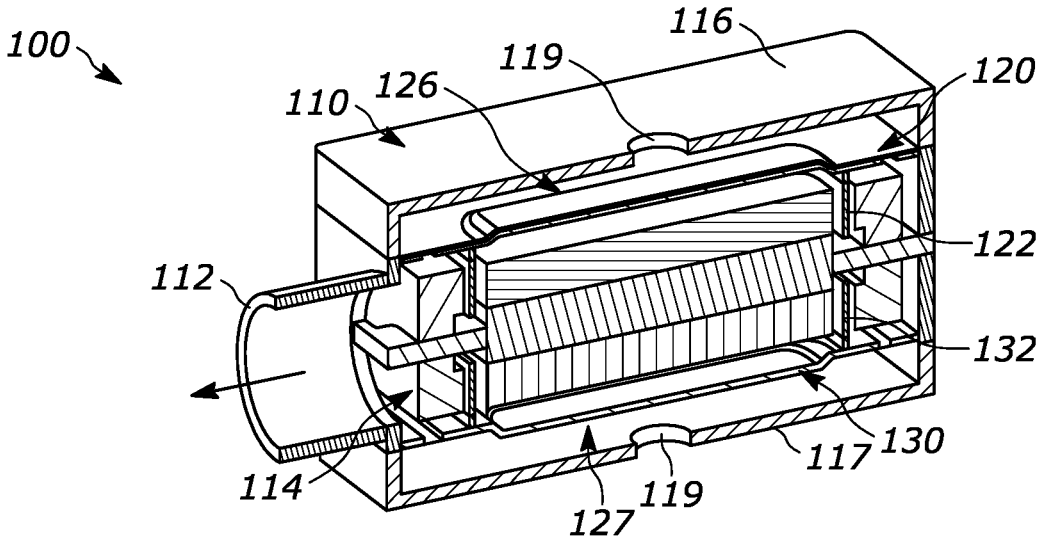
FIG. 6 is a sectional view of another representative audio transducer having a magnetic circuit with a peripheral outer pole portion.

In the representative embodiment of FIG. 5, the outer portion of the magnetic circuit comprises first and second discrete outer pole portions 164 and 166 arranged in parallel on opposite sides of the first and second coils. The discrete outer pole portions are separated by air gaps. Such a magnetic circuit creates looping magnetic fields through the inner pole portion and through each of the parallel outer pole portions. A frame structure 168 can support and retain the magnetic circuit within the housing as shown in FIGS. 1 and 2. In FIG. 5, the first outer pole portion is separated into two parts 164*a* and 164*b* and the second outer pole portion is separated into two parts 166*a* and 166*b* for assembly about the frame 168. Alternative configurations for supporting the magnetic circuit within the housing can also be used, some of which may not require a frame or separation of the outer pole portions into two or more separate parts. For example, the outer pole portion can constitute a portion of the housing sidewall, examples of which are illustrated and described herein.

Figure 7:
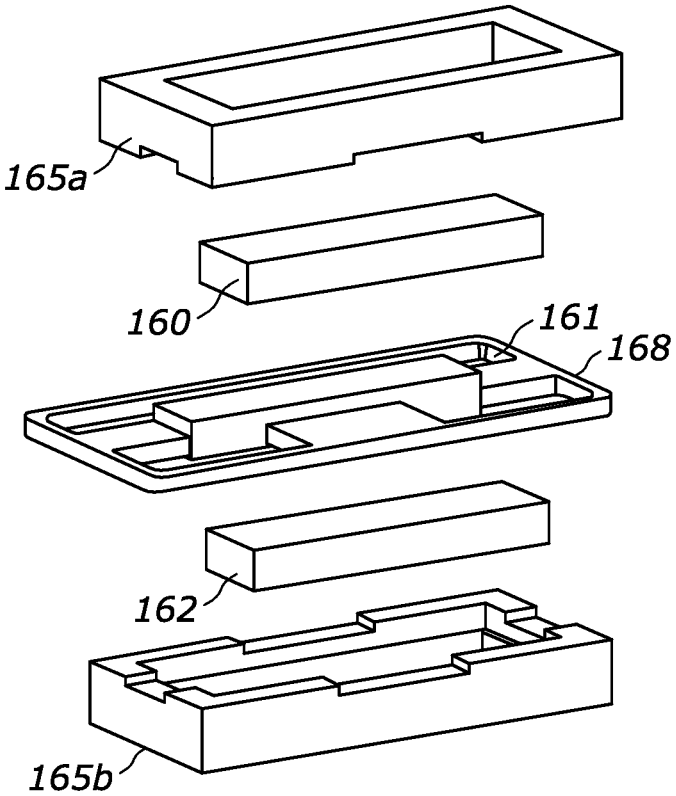
FIG. 7 is an exploded view of another representative magnetic circuit.
Figure 8:
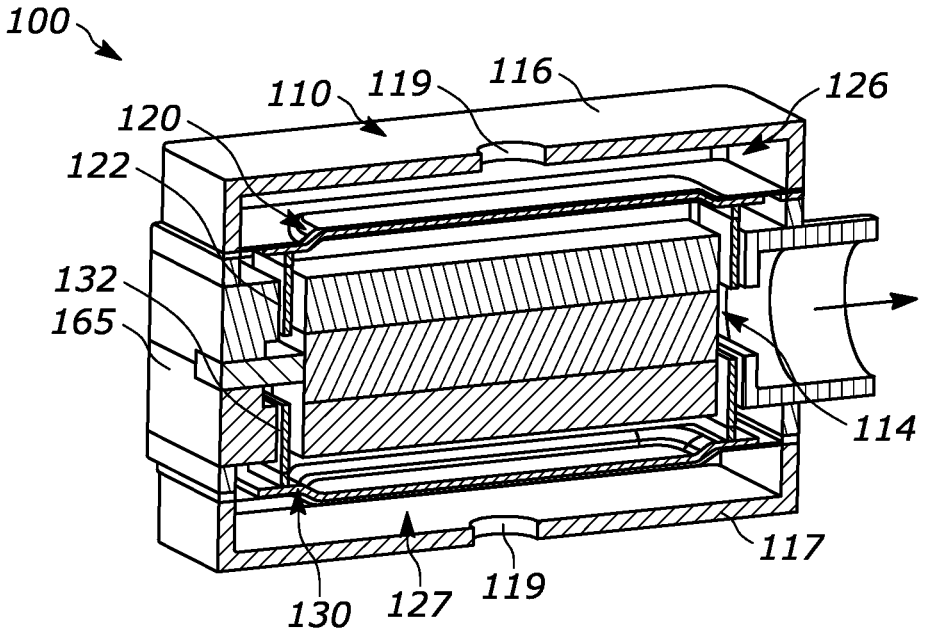
FIG. 8 is a sectional view of a representative transducer having a magnetic circuit that defines a portion of the housing.

In the representative embodiment of FIG. 7, the outer portion of the magnetic circuit comprises a continuous close-ended rectangular portion disposed about an outer side of the first and second coils. In FIGS. 12 and 14, the outer pole portion 165 is substantially continuous to accommodate the sound port between the front volume and an exterior of the housing. The sound port can be an opening through the outer pole portion or as a slot. Such a magnetic circuit creates a continuous pseudo-toroidal magnetic field through the inner pole portion and through the outer pole portions. A frame structure 168 can support and retain the magnetic circuit within the housing as shown in FIGS. 3, 6, 8, 13 and 14. The continuous close-ended rectangular portion is separated into separate parts 165*a* and 165*b* for assembly with the frame 168. Alternative configurations for supporting the magnetic circuit within the housing can also be used, some of which may not require a frame or separation of the outer pole portion into separate portions. In FIGS. 8 and 13, for example, the outer pole portion 165 of the magnetic circuit constitutes part of the housing.

In alternative magnetic circuit implementations, the inner and outer pole portions can have other shapes. In FIG. 7, the substantially continuous rectangular outer pole portion can include an air gap, forming an open-ended pole, where the air gap is located at an end corresponding to the location of the diaphragm hinge as shown in FIG. 10. In an open-ended pole configuration, the force generated by the coil would be asymmetric, with more force generated close to the free-end of the diaphragm that experiences the most motion. In FIGS. 12, 13 and 14, the inner pole portion 161 is cylindrical and the outer pole portion has a hollow cylindrical shape. In FIGS. 13 and 14, the outer pole portion is an assembly comprising outer pole portions 165*a* and 165*b*. The outer pole portions can facilitate assembly about supporting structure or accommodate a permanent magnet between outer pole portions 165*a* and 165*b* as described herein. Alternatively, the outer pole portion can be a unitary member. In FIGS. 12-14, the inner pole portion comprises an assembly of pole portions 160 and 162 on opposite sides of a magnet 161. In FIG. 13, the inner cylindrical pole portion comprises portions 160 and 162 having different diameters for driving different size coils and diaphragms. Other shapes and configurations are contemplated as well.

In some implementations, one or more permanent magnets can be located in portions of the magnetic circuit other than, or in addition to, the inner pole. For example, in FIG. 5, one or more permanent magnets can be located in the outer pole portions 164 and 166 alone or in combination with the magnet located in the inner pole portion. The inner pole portion can be a single element if a permanent magnet is not located in the inner pole portion. Locating the permanent magnets within the magnetic circuit symmetrically about the axial dimension of the coils may enhance or optimize the performance of the transducer.

Figure 15:
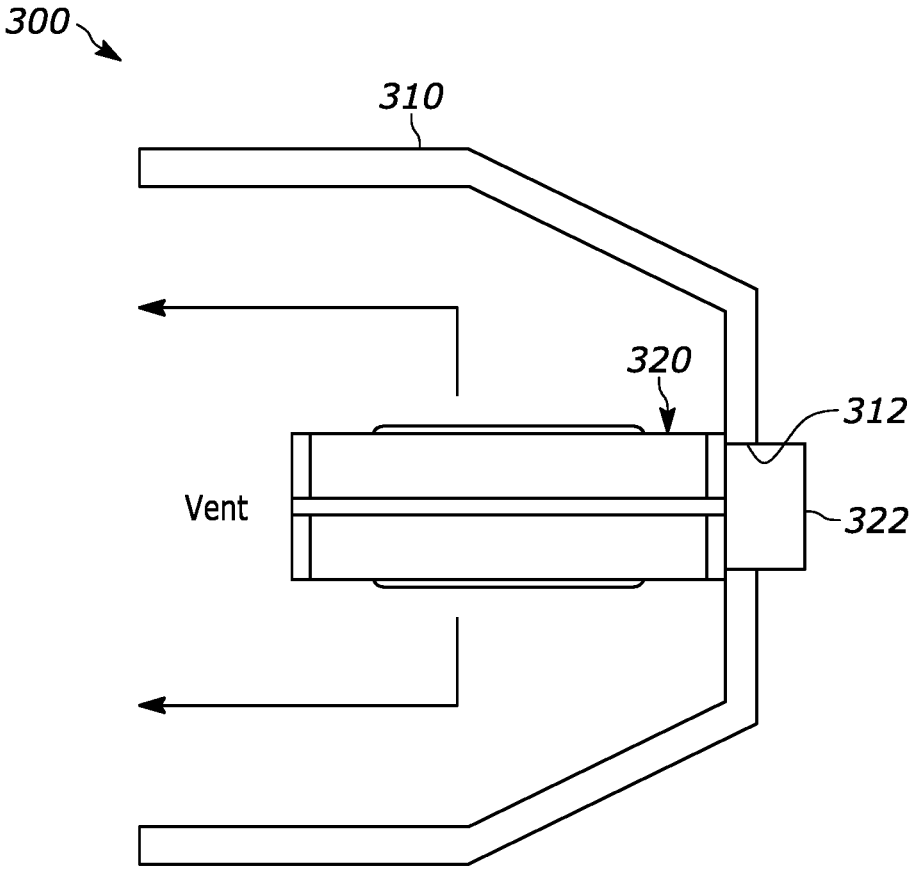
FIG. 15 is a sectional view of a hearing device including a transducer.
Figure 16:
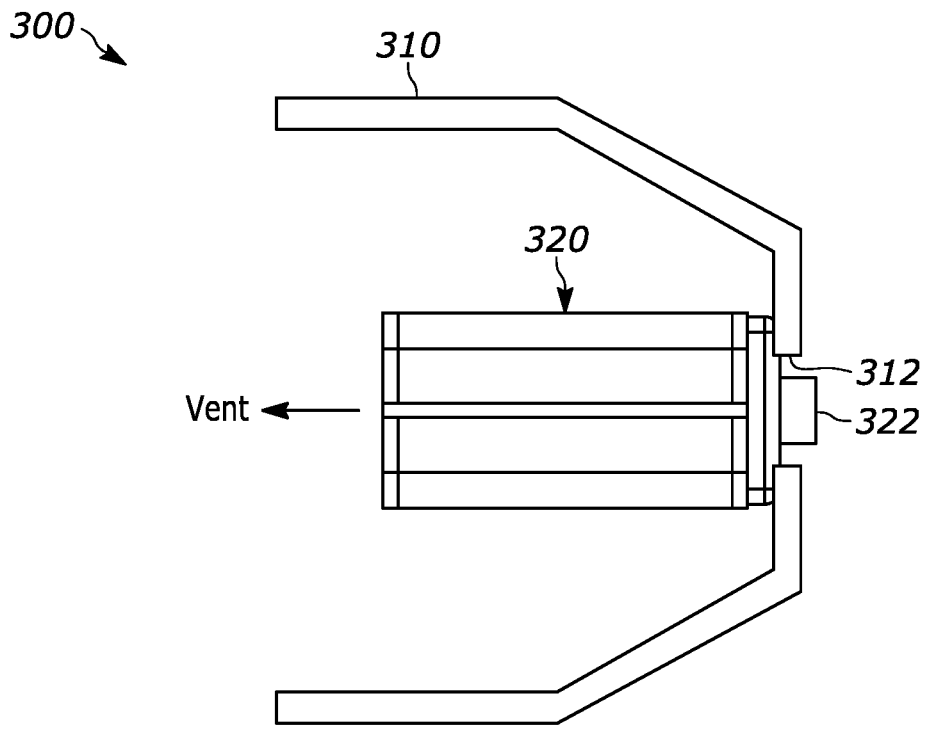
FIG. 16 is a sectional view of a hearing device including a different transducer.
Figure 17:
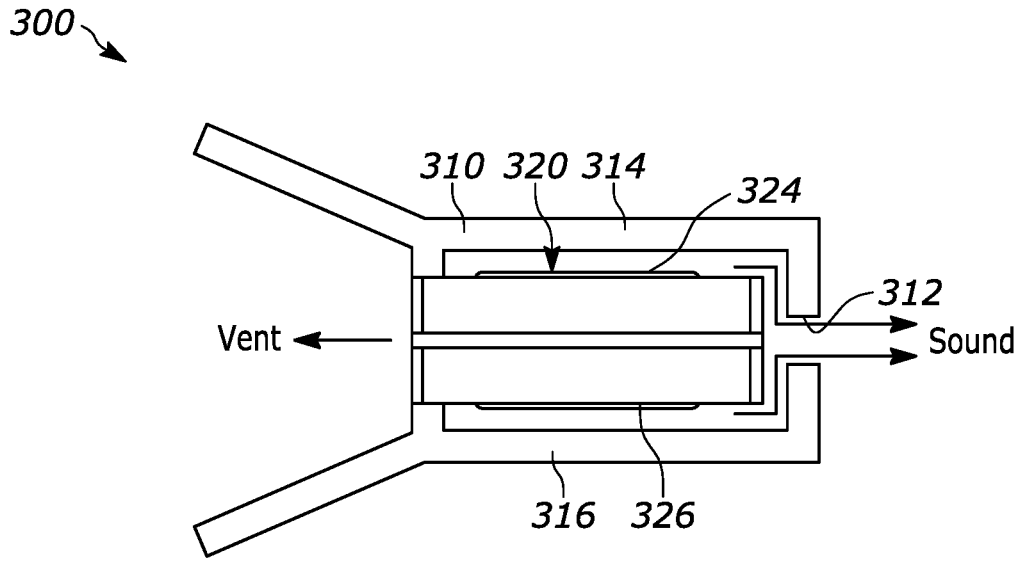
FIG. 17 is an alternative hearing device.

In FIGS. 15, 16 and 17, a hearing device 300 includes a housing 310 configured for wearing in or on a user's ear. The hearing devices each include an acoustic port 312 located to direct sound into the user's ear when the hearing device is worn by the user. Generally, the sound port of one or more audio transducers integrated with the hearing device is acoustically coupled to the acoustic port of the hearing device. The transducers 320 are oriented within the housings 310 so that axial dimensions of the coils are non-parallel to a direction in which sound is emanated from the acoustic port 312 of the hearing device. Multiple transducers can be integrated within each hearing device housing 310 by providing corresponding sound ports in the housing 310 or by porting the output of each transducer into a common sound conduit having an end coupled to the acoustic port 312. The outputs of the multiple transducers can be coupled to the common sound conduit by a manifold and, if necessary, the multiple transducers can be oriented so that the axial dimension of the coils is at an angle relative to a direction with which sound is emitted from the acoustic port 312.

In FIG. 15, the transducer 320 emits sound from the nozzle 322 via a front volume located between the first and second diaphragms as described herein in connection with FIGS. 1, 2, 4, 6, 8, 12 and 14. The back volumes of the transducer in FIG. 15 are both vented into the hearing device housing, which can be vented to the atmosphere. In FIGS. 16 and 17, the back volume is located between first and second diaphragms of the transducer, as shown in the representative embodiment of FIG. 3, and can be vented to the atmosphere. In FIG. 16, the transducer 320 emits sound from the nozzle 322 via two front volumes located between each of the first and second diaphragms and corresponding wall portions of the transducer housing as shown in FIG. 3. In FIG. 17, the transducer housing is open-ended and the transducer 320 emits sound from the nozzle 322 via two front volumes formed by exposed diaphragms 324 and 326 and corresponding wall portions 314 and 316 of the hearing device housing.

While the disclosure and what is presently considered to be the best mode thereof has been described in a manner establishing possession and enabling those of ordinary skill in the art to make and use the same, it will be understood and appreciated that there are many equivalents to the select embodiments described herein and that myriad modifications and variations may be made thereto without departing from the scope and spirit of the invention, which is to be limited not by the embodiments described herein but by the appended claims and their equivalents.

What is claimed is:

1. An audio transducer comprising:

a first diaphragm comprising a first paddle movably coupled to a first frame by a first flexible member, the first diaphragm comprising a first coil coupled to the first paddle;

a second diaphragm comprising a second paddle movably coupled to a second frame by a second flexible member, the second diaphragm comprising a second coil coupled to the second paddle, an inner portion of the first coil at least partially aligned with an inner portion of the second coil;

a magnetic circuit comprising an inner portion at least partially disposed between and within perimeters of the first coil and the second coil, an outer portion adjacent to outer portions of the first coil and the second coil, and a permanent magnet, wherein the first diaphragm moves in a first direction and the second diaphragm moves in a second direction, opposite the first direction, in response to electrical excitation of the first coil and the second coil.

2. The audio transducer of claim 1, the inner portion of the magnetic circuit comprising:

a first inner pole portion at least partially disposed within the inner portion of the first coil; and a second inner pole portion at least partially disposed within the inner portion of the second coil, wherein the permanent magnet is located between the first inner pole portion and the second inner pole portion.

3. The audio transducer of claim 2, the outer portion of the magnetic circuit comprising a continuous close-ended pole member disposed about the outer portions of the first coil and the second coil.

4. The audio transducer of claim 1, the first paddle is hinged to the first frame and the first paddle exhibits rotational movement about the hinge in response to the electrical excitation signal.

5. The audio transducer of claim 1, wherein the first diaphragm is parallel to the second diaphragm.

6. The audio transducer of claim 5 further comprising a housing, wherein a volume between the first diaphragm and the second diaphragm is a front volume acoustically coupled to a sound port of the housing.

7. The audio transducer of claim 6, wherein the housing is comprised of an open-ended sidewall, the first diaphragm covers a first open-end of the sidewall, and the second diaphragm covers a second open-end of the sidewall.

8. The audio transducer of claim 5 further comprising a housing, a first front volume between the first diaphragm and a first wall of the housing, and second front volume between the second diaphragm and a second wall, opposite the first wall, of the housing, the first front volume and the second front volume acoustically coupled to a sound port of the housing, wherein a volume between the first diaphragm and the second diaphragm is a back volume.

9. An audio transducer comprising:

a first diaphragm coupled to a first coil;

a second diaphragm coupled to a second coil;

a magnetic circuit comprising an inner portion at least partially disposed between and within perimeters of the first coil and the second coil, the magnetic circuit comprising an outer portion disposed at least partially about and adjacent to outer portions of the first coil and the second coil, and a permanent magnet;

a sound passage extending from a volume between the first and second diaphragms through an opening in the outer portion of the magnetic circuit, wherein the first diaphragm moves in a first direction and the second diaphragm moves in a second direction, opposite the first direction, in response to electrical excitation of the first coil and the second coil.

10. The audio transducer of claim 9, the outer portion of the magnetic circuit comprising:

a first outer pole portion adjacent first outer portions of the first coil and the second coil; and a second outer pole portion adjacent second outer portions, opposite the first outer portions, of the first coil and the second coil, wherein the first outer pole portion and the second outer pole portion are discrete pole members arranged in parallel.

11. The audio transducer of claim 9, the outer portion of the magnetic circuit comprising an open-ended outer pole portion having an arcuate portion disposed at least partially about the outer portions of the first coil and the second coil.

12. The audio transducer of claim 9, the outer portion of the magnetic circuit comprising a continuous close-ended pole member disposed about the outer portions of the first coil and the second coil, wherein the opening is an aperture through the continuous close-ended pole member.

13. The audio transducer of claim 9, the outer portion of the magnetic circuit comprising:

a first outer pole portion adjacent first outer portions of the first coil and the second coil; and a second outer pole portion adjacent second outer portions, opposite the first outer portions, of the first coil and the second coil, wherein the opening is an air gap separating the first outer pole portion and the second outer pole portion.

14. The audio transducer of claim 9, wherein the first diaphragm is parallel to the second diaphragm and axial dimensions of the first coil and the second coil are aligned.

15. The audio transducer of claim 9 further comprising a housing, wherein the volume between the first diaphragm and the second diaphragm is a front volume acoustically coupled to a sound port of the housing.

16. The audio transducer of claim 9 further comprising a housing, a first front volume between the first diaphragm and a first wall of the housing, and second front volume between the second diaphragm and a second wall, opposite the first wall, of the housing, the first front volume and the second front volume acoustically coupled to a sound port of the housing, wherein the volume between the first diaphragm and the second diaphragm is a back volume.

17. An audio transducer comprising:

a housing;

a first diaphragm coupled to a first coil, the first diaphragm and the first coil at least partially disposed in the housing;

a second diaphragm coupled to a second coil, the second diaphragm and the second coil at least partially disposed in the housing;

a magnetic circuit disposed in the housing and comprising a permanent magnet, an inner portion of the magnetic circuit at least partially disposed between and within perimeters of the first coil and the second coil, an outer portion of the magnetic circuit disposed at least partially about and adjacent to outer portions of the first coil and the second coil, the outer portion of the magnetic circuit forming a portion of the housing;

wherein the first diaphragm moves in a first direction and the second diaphragm moves in a second direction, opposite the first direction, in response to electrical excitation of the first and second coils.

18. The audio transducer of claim 17, wherein the first diaphragm is parallel to the second diaphragm.

19. The audio transducer of claim 18, wherein a volume between the first diaphragm and the second diaphragm is vented to an exterior of the housing by an opening through the outer portion of the magnetic circuit.

20. The audio transducer of claim 19, wherein the opening through the outer portion of the magnetic circuit is a gap between portions of the outer portion of the magnetic circuit.

* * * * *